US006679184B1

(12) United States Patent
Rajaram

(10) Patent No.: US 6,679,184 B1
(45) Date of Patent: Jan. 20, 2004

(54) SUSPENDED COACH TRANSPORTATION SYSTEM

(75) Inventor: Bojji Rajaram, Navi Mumbai (IN)

(73) Assignee: Konkan Railway Corporation Ltd., Munbal (IN)

( * ) Notice: Subject to any disclaimer, the term of this patent is extended or adjusted under 35 U.S.C. 154(b) by 0 days.

(21) Appl. No.: 10/206,301

(22) Filed: Jul. 26, 2002

(30) Foreign Application Priority Data

Jul. 26, 2001 (IN) ..... 719/MUM/2001
Jul. 26, 2001 (IN) ..... 718/MUM/2001

(51) Int. Cl.[7] ..... B61B 3/00
(52) U.S. Cl. ..... 104/89; 104/249
(58) Field of Search ..... 104/89, 249, 254; 105/392.5

(56) References Cited

U.S. PATENT DOCUMENTS 2,985,376 A * 5/1961 Smith ..... 104/89
3,225,228 A * 12/1965 Roshala ..... 310/12
3,559,583 A * 2/1971 Chadenson ..... 104/89
3,774,542 A * 11/1973 Walsh ..... 104/89
3,847,085 A * 11/1974 Rypinski ..... 104/89
3,915,093 A * 10/1975 Barthalon et al. ..... 104/89
3,987,734 A * 10/1976 Horn ..... 104/89
5,904,099 A * 5/1999 Danneker ..... 104/249

* cited by examiner

*Primary Examiner*—S. Joseph Morano
*Assistant Examiner*—Lars A Olson
(74) *Attorney, Agent, or Firm*—Muserlain, Lucas and Mercanti

(57) ABSTRACT

A method and apparatus for clearing an immobilized and or derailed suspended coach is described. The suspended coach forms part of a suspended coach transportation system in which suspended coaches suspended from a suspender beam fitted to a conventional rail bogie with wheel sets moves on rail fitted in a concrete box guide way. The method and apparatus involves extending the suspender beam to make it longer than the coach body and providing the ends of the suspender beams with n extensor and lifting mechanism for permitting an assisting mobile coach to use its suspender beam to lift an immobilized coach at its suspender beam and carry or push the immobilized coach for clearance. A method of clearing an immobile or derailed suspended coach in a suspended coach transportation system is also disclosed.

2 Claims, 4 Drawing Sheets

SUSPENDED COACH TRANSPORTATION SYSTEM

PRIOR ART

This invention relates to an elevated suspended transportation method and apparatus and devices therefor.

In our co-pending Indian application 715/mum/2001 there is disclosed a transportation system, capable of providing high capacity lateral transportation in downtown core areas.

Particularly, this invention relates to safety device for minimizing damage to suspended coaches and passengers and cargo therein in the case of collision between coaches located on the same rail track.

PRIOR ART

All over the world, populations are rising and the infrastructure development is not keeping pace. The roads are unable to handle the rising number of vehicles and metro rails face inadequacies in increasing the capacity, besides the risk of vandalism and derailment. Expansions or new constructions need land in urban areas, which is not possible; alternative underground railways are too expensive. Transportation is a critical element in the smooth and efficient operation of almost every aspect of today's cities aid urban areas. As a result, many types of transportation systems have been developed to move people and cargo from one place to another more efficiently. The most prominent transportation systems are overland travel by automobiles and bogies, both operating on roads such as public highways. Public buses utilize the same highway network, as do, to some extent, cable cars and electric buses. Conventional high capacity urban transportation systems generally employ underground trains or streetcars moving along conventional rails. Such systems take up a considerable amount of space in the urban area and do not allow the individual cars to be separately directed. Subways, monorails, and trains, however, utilize a rail network that is typically less developed than the surrounding highway networks. Other forms of inter-city transportation include the bicycle, auto rickshaws, scooters and motor cycles, all of which use the same roads. Consequently the roads are unable to handle the rising number of vehicles.

Public buses also utilize the highway network, but are far less popular than automobiles. Buses are less favored than automobiles because one must often wait at a bus stop for a relatively long period of time and in potentially disagreeable weather. Further, buses are generally restricted to particular routes, and consequently a bus rider must walk, or acquire other transportation, to and from bus stops along various routes proximate to his origination and destination. Frequently, transfers must be made from one bus to another due to inadequate routes, and frequent interim stops must be made to load or unload other passengers. Still further, buses are subject to many of the same drawbacks as the automobile, such as traffic, stop lights, and traffic risk. As a result, buses are not as popular as the automobile even though, when properly utilized, buses are more efficient and less environmentally harmful than the cumulative effect of so many individual automobiles.

Rail-guided vehicles, such as trains, monorails, and subways, are an alternative transportation system found in many cities and urban areas. When properly utilized, such systems are more energy efficient than automobiles and less environmentally damaging. However, many of the same drawbacks exist for rail guided vehicles as for busses. For example, rail guided vehicle users are dependent upon predetermined and often inadequate schedules, a limited number of fixed routes, and lost time due to stops at intermediate stations for other passengers. Even the relatively high speeds attained by rail-guided vehicles do not fully compensate for the time lost in other ways when using such transportation systems. Surface railway is impossible to lay in an existing city. But even to lay the same in an new development is subject to negative implications. The development remains divided by the corridor and it a permanent noise polluter. Sudden disgorging of heavy loads of commuters at stations creates needless congestion on the roads reducing the quality of life. Several thousands of persons die annually because of trespassing or falling from trains. In addition derailments, collisions and capsizing cause serious damage to life and limb and property.

Underground railway is less invasive on the surface but still poses technical challenges including the management of fires and evacuation. If road vehicles are involved in intermodal transfers, it becomes a weak link in the chain of transport between walking and the railway.

Elevated railway technically cannot reach congested central busy roads where mass transport is needed. It is too invasive and may require dislocation of some portions of the habitat as well as the system is very noisy.

Consequently, cities and urban areas have been plagued by the problems associated with having private automobiles as the primary mode of civilian transportation. A person will readily spend hours in heavy traffic either because there is no alternative, or because any available alternatives require more time and inconvenience. Moreover, the pollution created by millions of private automobiles is having an immeasurable effect on the environment and quality of civilian life, not only in urban areas but in the surrounding rural areas as well. The cumulative energy wasted at stoplights and in traffic is considerable, and causes a direct increase in fuel costs and other costs associated with automotive transportation. The energy required to accelerate an automobile that weighs several thousand kilograms is frequently converted into little more than friction within the automobile's braking system at the next traffic light. This is a considerable amount of wasted energy since the average human occupant in a typical automobile represents a mere 5% of the gross vehicle weight. Still further, dependence upon extremely large amounts of fossil fuels to power a large automotive transportation system makes such a society somewhat vulnerable to the whims of those who posses fossil fuel reserves.

OBJECTS OF THE INVENTION

Clearly, then, there is a need for a civilian transportation system that is able to compete with the automobile in terms of convenience to the user, but does not require the tremendous energy consumption of an automotive transportation system. Further, such an improved transportation system should provide increased safety expectations, less overall cost to the user, and profitability to those manufacturing, owning, and operating such a system. All administrations are in search of an economical viable solution to the transportation problem, which is concomitantly environment-friendly.

The present invention relates to a public transportation system that fulfills these needs and provides further related advantages.

An object of the present invention is to provide a versatile urban transportation system that has hitherto been impossible using systems of the prior art, particular a transportation system which is safe and in which the damage as a result of an unlikely collision between two sets of coaches which happen to be positioned on the same rail track accidentally is minimized.

The present invention relates to damage control in the case of collision in the novel suspended coach rail transportation system of this invention.

Specifically, the present invention relates to a means of improving the safety levels of suspended coach rail transportation systems and more specifically, methods, means and devices controlling the damage in the case of collision to coaches.

Single supporting rail suspended monorail systems have been built in the past. The potential of high-speed operation requires that the attitude of the cars is securely controlled and capsizing of the coaches and derailment of the bogies carrying the cars be prevented.

SUMMARY OF INVENTION

The principal objective of the present invention is to provide in a suspended coach transportation system that includes a bogie, that can operate inside a continuous box type closed horizontal beam having a slot in lower surface for the traverse of the coach body support, that will eliminate the possibility of derailment of the bogie due to forces acting upon the bogie, an improvement such that the suspender beams from which the coaches are suspended are made operatively longer than the coach length and therefore only the ends of the suspender beams of respective coaches strike each other, said ends also being defined by shock absorbing and damping means and crunching means to ensure that any collision where one or both the coaches are in motion at high speeds is controlled/damped.

In the present invention there is provided in a suspended coach transportation system comprising an extended continuous hollow box way having a slot throughout its operative under wall, said box way being elevated by columns from the ground level and generally following the lay of the ground; a pair of rails fixed on either side of the slot on the operative inner surface of the under wall within the extended box way and extending continuously throughout the box way; a plurality of bogie assemblies moving on the said rails within the box way; removably mounted coaches suspended from suspension means extending through the slot in the box way the bogie assemblies being generally connected to the coach suspension means in a manner that permits controlled longitudinal, swinging and angular displacement of the coaches and their suspension means, means to minimize damage to the coaches in the case of a collision comprising suspender beams from which the coaches are suspended which are longer than and extend beyond the effective length of the coach sets on each suspender beam; the ends of the suspender being having shock absorbing means.

Typically in accordance with a preferred embodiment of this invention, the bogie is secured to a suspender beam via a connecting steel load transfer beam and spring loaded bolsters, to dampen the jerks and other movements from the rails to the bogie wheels. The bogies are also secured to the suspender beams via means of central pivots which permit controlled play and limited angular displacement of the bogie assembly on the suspender beam, if necessary.

The collision protection method further provided in accordance with this invention involves increasing the length of the suspender beams to be longer than the coach units suspended below, so that if a coach unit were to ram into another, the suspender means ends take the impact of the collision and absorb the impact energy. In any case direct impact between the coaches is prevented.

According to this invention there is provided a method of minimizing damage during collision between suspended coaches in a suspended coach transportation system comprising the steps of distancing the suspended coaches by making the suspender beams longer than the length of the coaches; damping impact energy by providing impact damping means at the ends of the beams; and absorbing the impact energy by making the ends of the suspender beams deformable on impact.

According to this invention there is also provided an apparatus for minimizing damage during collision of suspended coaches used for transporation, which comprises suspender beams fitted to the suspended coaches said suspender means having a length longer than the length of the coaches; the ends of the suspender beams adapted to deform under impact to absorb impact energy and impact damping elements provided on the ends of the suspender elements to damp the energy of impact.

Typically the impact damping elements are secured to the extremities of the suspender beams via buffer springs.

Typically, the ends of the suspender beams are made of deformably crushable material such as hollow metal sections.

In accordance with another aspect of this invention it relates to a method and device for clearing immobilized suspended coaches in the novel elevated suspended transportation system.

The present invention provides a method and apparatus for clearance of suspended coaches in the proposed novel public transportation system that fulfills the needs and provides further related advantages.

An object of the present invention is to improve the versatility of the urban transportation system that has hitherto been impossible using systems of the prior art, particular a transportation system which is safe and in which the damage as a result of an unlikely collision between two sets of coaches which happen to be positioned on the same rail track accidentally at the same time the collision control devices can be used and the method and apparatus of this invention can be used for clearing an immobilized coach unit.

The present invention also relates to a novel method for clearing an immobilized suspended coach in the novel suspended coach rail transportation system of this invention.

Specifically, the present invention relates to a means of efficiently clearing an immobilized coach in the suspended coach rail transportation systems and more specifically, methods, means and devices for quick and efficient clearance of unserviceable and failed bogie units attached to immobilized coaches.

Single supporting rail suspended monorail systems have been built in the past. The potential of high-speed operation requires that the attitude of the cars is securely controlled and capsizing of the coaches and derailment of the bogies carrying the cars be prevented.

The principal objective of the present invention is to provide in a suspended coach transportation system suspended from a suspender bar a method of clearance of an immobilized coach unit.

Typically as a feature of the coach unit the suspender beams from which the coaches are suspended are made operatively longer than the coach length and the ends of the suspender beams of respective coaches have an extension mechanism which are used for clearance of an immobilized unit.

According to the present invention there is provided a method of clearance of an immobilized suspended coach in a suspended coach transportation system in which coaches are suspended from a suspender beam; in which the suspender beam is made longer than the length of the suspended coach. the end of one coach unit, being the assisting coach unit being adapted to be displaced to be positioned below the end of an immobilized coach unit and further adapted to raise the suspender beam by a pre determined distance such as a few mm and thereby lift the bogie assembly of the immobilized unit of the rail track and displace the immobilized bogie for clearance.

The coaches are removably connected to suspender shafts, which permits fast and efficient removal and replacement of the coaches with other coaches or with load carrying cargo carrying means, if desired.

According to this invention there is provided a method of clearing an immobile or derailed suspended coach in a suspended coach transportation system comprising the steps of providing the suspender coaches with suspender beams longer than the coach length;

moving a mobile suspended coach towards the immobile or derailed suspended coach so that the ends of the immobile or derailed coach and the mobile coach abut;

providing the suspended beam ends with an extensor and lifting mechanism which can extend from the suspender beam of the mobile coach and extend below the suspender beam of the derailed coach, latch on to the bottom surface of the suspender beam and lift the beam and the coach so that the wheels of the bogie of the derailed coach are effectively above the rails on which the coaches traverse;

displacing the mobile suspended coach with the derailed coach secured thereto away from the rail line to clear the derailed coach.

According to this invention there is also provided an apparatus for carrying out the method of clearing immobilized or derailed suspended coaches, which comprises fitting the suspended coaches with suspender beams longer than the length of the coaches; and providing the ends of the suspender beams with an extensor and lifting mechanism adapted to permit extension of a portion of the beam end of one suspended coach below the end of the suspender beam of another coach in an abutted configuration to lift an immobilized or derailed coach and displace it for clearing.

BRIEF DESCRIPTION OF THE DRAWINGS

The invention will now be described with reference to the accompanying drawings, in which.

DETAILED DESCRITPION OF THE DRAWINGS

Figure 1:
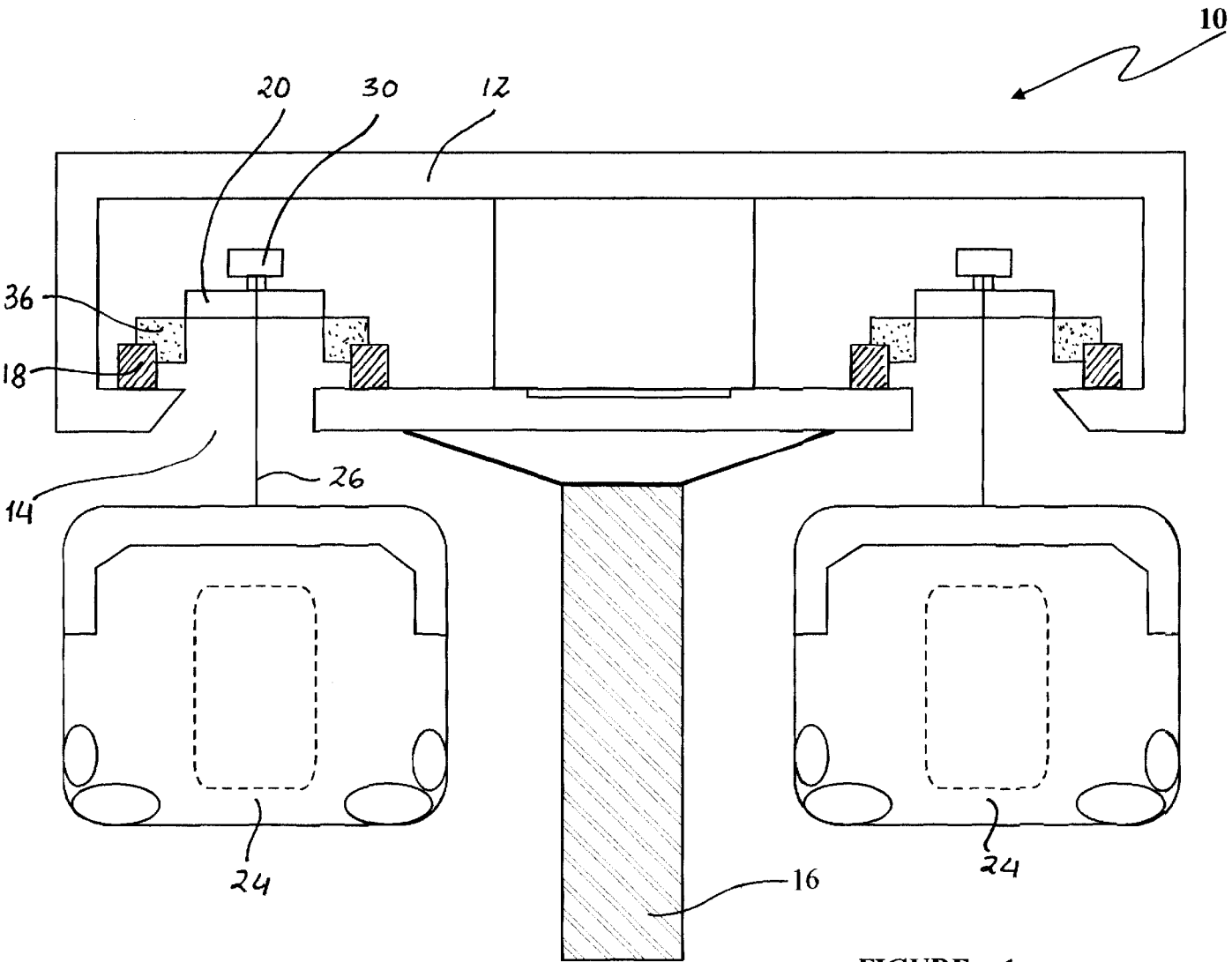
FIG. 1 shows a schematic sectional view of the arrangement for a suspended coach rail transportation system in accordance with this invention.
Figure 2:
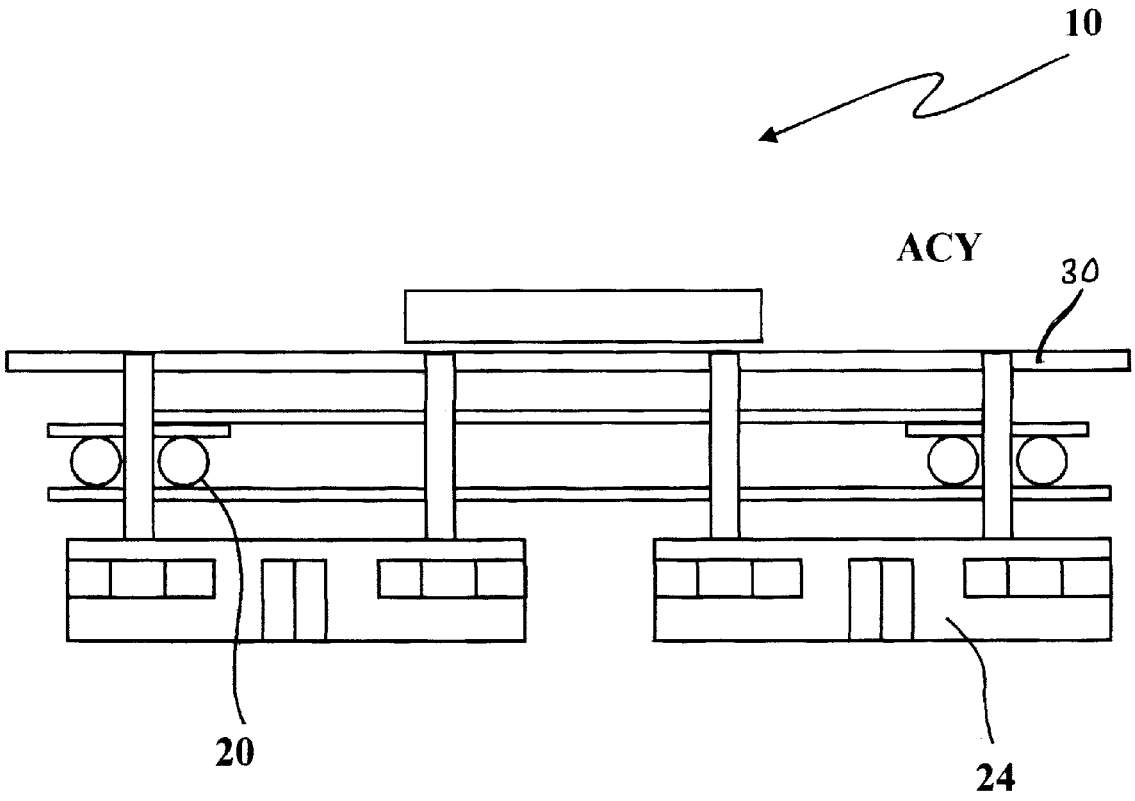
FIG. 2 shows a side schematic view of the suspended coach system FIG. 1.

Referring to the drawings, FIG. 1 shows a schematic sectional view of a suspended coach transportation system in accordance with this invention.

The transportation system generally indicated by the reference numeral 10 comprises an extended continuous hollow box way 12 having a slot 14 throughout its operative under wall. Columns 16 elevate the box way 10 from the ground level and generally following the lay of the ground. A pair of rails 18 are fixed on either side of the slot 14 on the operative inner surface of the under wall within the extended box way 12. The rails extend continuously throughout the box way. A plurality of bogie assemblies 20 move on the said rails 18 within the box way 12.

Removably mounted coaches 24 are suspended from suspension shafts 26 extending through the slot 14 in the box way 12 and secured to a suspender beam 30. The bogie assemblies 20 are generally connected to suspender beams. The coach suspension means permit controlled longitudinal, swinging and angular displacement of the coaches 24 and their suspension means.

The box way 12 is a concrete box way and an array of central columns 16 support two extending box ways on either side of the columns as seen in FIG. 1. These box ways 12 permit traverse of suspended coaches along the box ways on either side and alongside of the columns, typically in opposite directions.

As seen in the Figures, the box way 12 has a generally rectangular or square cross section defined by a pair of horizontal and a pair of vertical walls typically of concrete said walls enclosing a space; one of said horizontal walls, typically the under wall of the box way defining a continuous slot 14.

The extended box way is constructed by aligning and joining a plurality of pre fabricated box way segments secured to the columns. The box ways on either side of the columns are integral with each other.

The columns 16 are typically 1 m-diameter columns 8 m high spaced apart by a distance of advantageously 15 m with respect to each other and formed in the divider space between the carriageways on a roadway.

Typically the coaches 24 are suspended at a height of 2 m to 4 m above the road surface/ground level.

The rails 18 are fitted in an elastic medium dampened by inertia of measured mass.

Conventional rails used for over ground railways are used as the guiding rails in the box ways.

The bogie assembly 20 is secured to a suspender beam 30 via a connecting steel load transfer beam and spring-loaded bolsters, to dampen the jerks and other movements from the rails to the bogie wheels 36. The bogies 20 are also secured to the suspender beams 30 via means of central pivots, which permit controlled play, and limited angular displacement of the bogie assembly 20 on the suspender beam 30, if necessary.

The coaches 24 are suspended from the suspender beam 30 by a plurality of suspender shafts 26.

The coaches are removably connected the suspension shafts, which permits fast and efficient removal and replacement of the coaches with other coaches or with load carrying. Cargo carrying means, if desired. Thus the coaches are coupled to the bogie assemblies indirectly. The central pivot type coupling between the bogie assembly and the suspender beam provide controlled limited angular displacement and swing in a direction perpendicular to the direction of motion.

The coaches 24 are preferably passenger cabins connected indirectly to the bogie assemblies by a rotational coupling that allows the passenger's cabin to remain in the vertical orientation while the attitude of the bogie changes.

Figure 3:
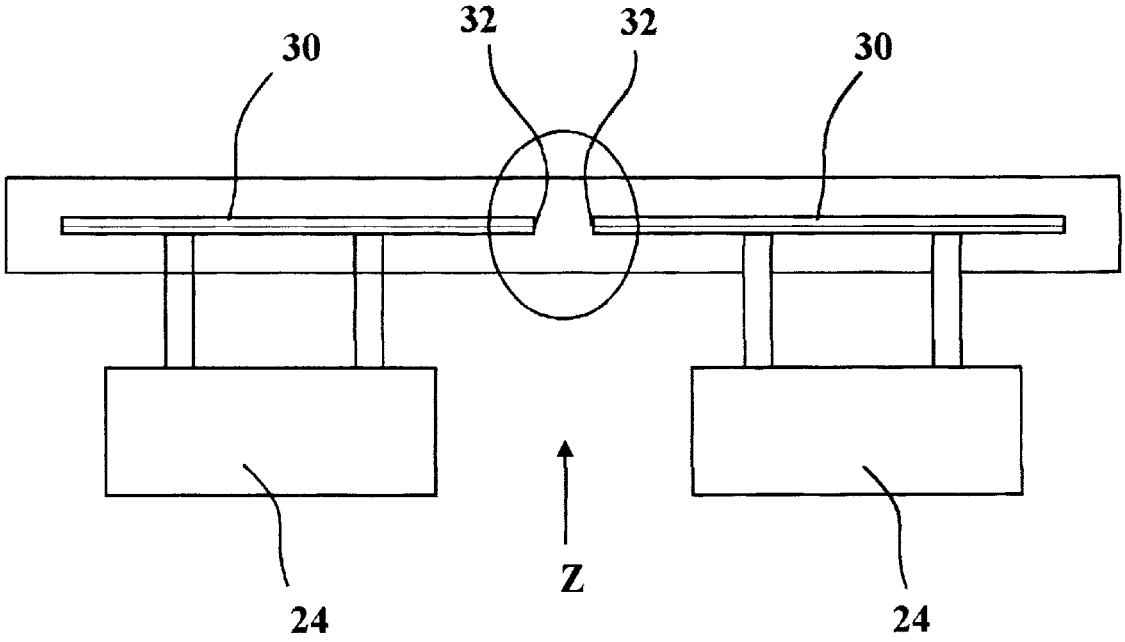
FIG. 3 shows schematic details of the suspender beams and the ends of the suspender beams schematic view for impact damping and absorption.
Figure 4:
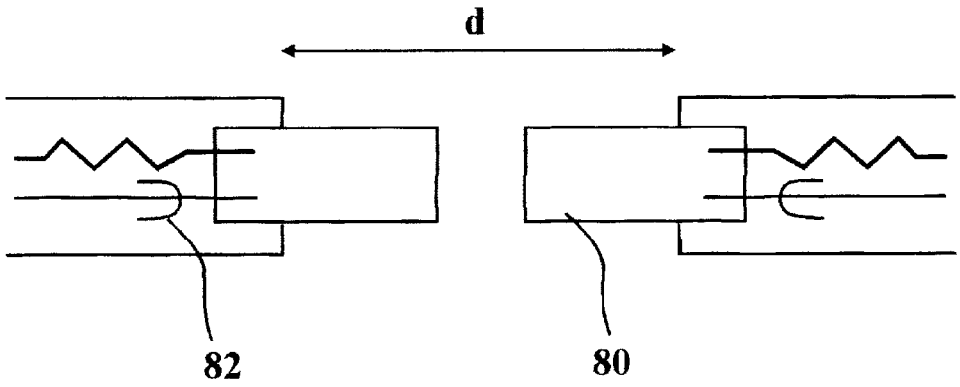
FIG. 4 shows details of the ends of the suspender beams for impact damping and absorption.

Referring to FIGS. 3 and 4, the collision protection method further provided in accordance with this invention involves increasing the length of the suspender beams 30 to be longer than the coach units 24 suspended below, so that if a coach unit 24 were to ram into another, the suspender means ends 32 take the impact of the collision by first damping and then absorbing the impact energy in the region Z marked in FIG. 3. In any case direct impact between the coaches is prevented. As seen in FIG. 4, the impact absorbing ends 80 have a impact absorbing region 'd' which is typically 2.5 m spaced apart. For the ends of the coaches to come into contact they will have to travel a distance 2.5 m after the elastic absorption of impact energy.

At the ends 80 are provided impact damping elements 82 secured to the suspender beams 30 via spring loaded shock absorption means, which damp the impact energy. The ends 32 are made of deformable material, such as for example of hollow metal sections which after full elastic retraction of the damping elements 80 deformably crush. It is only then that the solid steel bar beams come into contact. As seen in FIG. 3, the effective distance between the coach units is 2.5 meters when the ends 32 abut each other on impact. The suspender beams 30 will have to be crushed by this distance before the coaches 24 actually touch which is not likely even at the highest possible speeds attainable by each coach unit.

Figure 5:
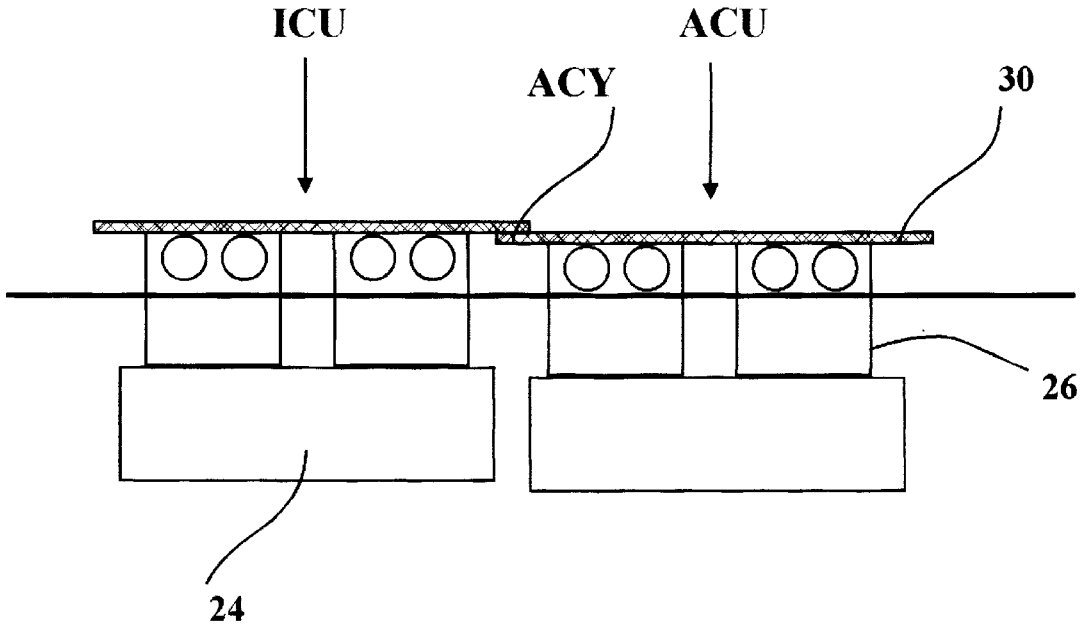
FIG. 5 shows schematic details of the method of clearance of an immobilized coach unit by an assisting coach unit.

Referring to FIG. 5, the immobilized or derailed coach clearance means provided in accordance with this invention involves increasing the length of the suspender beams 30 to be longer than the coach units 24 suspended below, so that if a coach unit 24 were to ram into another, the suspender beam ends take the impact of the collision and absorb the impact energy. In any case direct impact between the coaches is prevented.

The suspender beam ends are also used for clearing an immobilized coach unit ICU with the help of an assisting coach unit ACU as seen in FIG. 5. The assisting coach unit ACU is displaced towards the immobilized coach unit ICU until the ends of the suspender beams are aligned. The end of the assisting coach unit ACY is then displaced to lie under the end of the immobilized coach unit ICU as seen in FIG. 5. The end and therefore the suspender beam of the immobilized coach unit is raised. This action lifts the bogie wheels of the immobilized coach unit of the track and the assisting coach unit ACU can then push the immobilized coach unit for clearance.

Figure 6A:
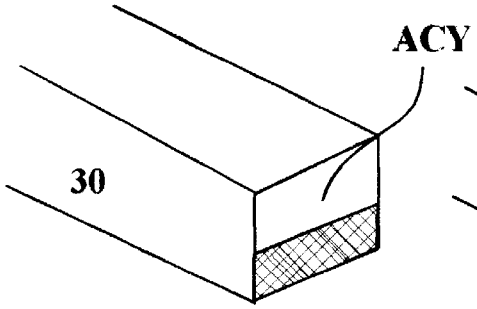
FIGS. 6*a* and 6*b* show a schematic end detail of a suspender beam.
Figure 6B:
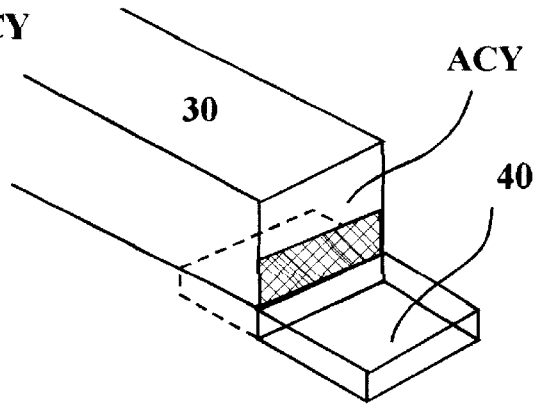

A typical example of the extensor and lifting mechanism 40 is seen in FIGS. 6*a* and 6*b* where the end ACY of a suspender beam 30 has a lower plate 40 which can be extended and bent to raise the suspender beam of an immobilized coach.

The coach and bogie configuration is unique in its function of mobility, directional control, track interface, suspension, and flow extraction. The clearance method is also unique in its structural simplicity, universality of application in the transport sphere, and its passive operation.

Although the invention has been described in terms of particular embodiments and applications, one of ordinary skill in the art, in light of this teaching, can generate additional embodiments and modifications without departing from the spirit of or exceeding the scope of the invention. Accordingly, it is to be understood that the drawings and descriptions herein are proffered by way of example to facilitate comprehension of the invention and should not be construed to limit the scope thereof.

I claim:

1. A method of clearing an immobile or derailed suspended coach in a suspended coach transportation system comprising the steps of providing the suspender coaches with suspender beams longer than the coach length;

moving a mobile suspended coach towards the immobile or derailed suspended coach so that the ends of the immobile or derailed coach and the mobile coach abut;

providing the suspended beam ends with an extensor and lifting mechanism which can extend from the suspender beam of the mobile coach and extend below the suspender beam of the derailed coach, latch on to the bottoms surface of the suspender beam and lift the beam and the coach so that the wheels of a bogie of the derailed coach are effectively above the rails on which the coach are effectively above the rails on which the coaches traverse;

displacing the mobile suspended coach with the derailed coach secured thereto away from a rail line clear the derailed coach.

2. An apparatus for carrying out the method of clearing immobilized or derailed suspended coaches of claim 1, which comprises fitting the suspended coaches with suspender beams longer than the length of the coaches; and providing the ends of the suspender beams with an extensor and lifting mechanism adapted to permit extension of a portion of the beam end of one suspended coach below the end of the suspender beam of another coach in an abutted configuration to lift an immobilized or derailed coach and displace it for clearing.

* * * * *